US006790109B1

(12) United States Patent
Heer et al.

(10) Patent No.: US 6,790,109 B1
(45) Date of Patent: Sep. 14, 2004

(54) ELECTRIC RUDDER PROPELLER OF LOWER INSTALLATION HEIGHT

(75) Inventors: Manfred Heer, Düngenheim (DE); Wolfgang Rzadki, Glinde (DE)

(73) Assignees: Siemens Aktiengesellschaft, Munich (DE); Schottel GmbH & Co. KG, Rein (DE)

( * ) Notice: Subject to any disclaimer, the term of this patent is extended or adjusted under 35 U.S.C. 154(b) by 0 days.

(21) Appl. No.: 10/018,114

(22) PCT Filed: Feb. 25, 2000

(86) PCT No.: PCT/DE00/00537

§ 371 (c)(1),
(2), (4) Date: Nov. 13, 2002

(87) PCT Pub. No.: WO00/68073

PCT Pub. Date: Nov. 16, 2000

(30) Foreign Application Priority Data

May 11, 1999 (WO) ..... PCT/DE99/101422
Jun. 24, 1999 (DE) ..... 199 28 961
Jun. 24, 1999 (WO) ..... PCT/DE99/01842

(51) Int. Cl.[7] ..... B63H 5/125
(52) U.S. Cl. ..... 440/53; 440/6
(58) Field of Search ..... 440/6, 38, 53, 440/75, 83

(56) References Cited

U.S. PATENT DOCUMENTS 4,634,908 A * 1/1987 Sturm ..... 310/64
4,678,439 A 7/1987 Schlichthorst
4,911,666 A * 3/1990 Gage et al. ..... 440/89 R

FOREIGN PATENT DOCUMENTS

CA 1311657 12/1992

OTHER PUBLICATIONS

Gloel und Grang "Ein neues hocheffizientes Antriebssystem" Schiff und Hafen, Oct. 1997, pp. 40–44, XP000720093, Hamburg.
ABB Azipod Oy "Azimuthing electric propulsion drive" XP000783547, Helsinki, Finland.
Ship &Boat International "Austrian River Icebreaker with Azipod Propulsion", XP0005170471, Jun. 1995, pp. 5–9, Maidstone, Kent, GB.

* cited by examiner

*Primary Examiner*—Stephen Avila
(74) *Attorney, Agent, or Firm*—Baker Botts L.L.P.

(57) ABSTRACT

An electrical steering propeller for a seagoing high-speed ship having a polyphase electric motor which is mounted under the stern of the ship via a shaft which can rotate and preferably has two parts in a gondola-like housing, and can be supplied with electrical drive power via a slipring arrangement, and can be rotated via drive motors, wherein the steering propeller is mounted in the stern of the ship via a flat collar bearing (7) in the vicinity of the outer skin (6), in particular above the waterline, with the slipring arrangement (8) being accommodated in the upper part (3) of the shaft (2,3) at the level of the annular bearing (7), and with the drive motors for the rotary movement (9) being physically small and being arranged at least partially in the interior of the collar bearing (4).

26 Claims, 6 Drawing Sheets

ELECTRIC RUDDER PROPELLER OF LOWER INSTALLATION HEIGHT

FIELD OF THE INVENTION

The present invention relates to a seagoing high-speed ship having an electrical steering propeller which has a polyphase electric motor which is mounted under the stern of the ship via a shaft which can rotate and preferably has two parts in a gondola-like housing, and can be supplied with electrical drive power via a slipring arrangement which can be rotated via drive motors.

BACKGROUND OF THE INVENTION

CA 1,311,637 A discloses an electrical steering propeller having a tubular shaft inside the ship with a slipring body located above the shaft. The prospectus from Siemens and Schottel, entitled "The SSP Propulsor", No. 159U559 04982, April 1998, also discloses a steering propeller which can be rotated, in which the sliprings for transmission of the electrical drive power are arranged the same way as the hydraulic drive motors for the rotary movement with their hydraulic pumps located in a drive machine room (Propulsor 500 m) above the steering propeller. Cables located from above are supplied to the sliprings.

SUMMARY OF THE INVENTION

The object of the present invention is to refine known drives such that more space is obtained in the stern of the ship. This is particularly important in Roro-ships where it is desirable to construct a continuous internal car deck without the stern door for the car deck, or the car deck itself, having to be raised. It is also important to retain adequate capabilities for repair and maintenance. It is a further object to design conditions downstream from the stern to minimize drag, taking into account the flow conditions resulting from the use of steering propellers.

These objects are achieved by mounting the steering propeller in the stern of the ship via a flat collar bearing in the vicinity of the outer skin, and preferably above the waterline. The slipring arrangement is accommodated in the upper part of the shaft at the level of the annular bearing, and with the drive motors for the rotary movement being physically small and arranged at least partially in the interior of the collar bearing in order to achieve a small installed arrangement for the electrical steering propeller. While at first blush it may appear to be impossible to accommodate the sliprings and the drive motors in the upper part of the shaft due to the construction of its "rotating bearing" and still provide a downward passage, the invention is made feasible by optimizing the sizes of all the parts and by largely dispensing with horizontally running struts. This makes it possible to move the drive motors to the area under the slipring arrangement.

The flat collar bearing can be arranged both above the waterline and below the waterline. In the case of an arrangement below the waterline, it is advantageous to maintain an increased pressure. However, the arrangement disclosed in CA 1,311,657A, where the shaft enters the ship below the waterline with an internal extension of the shaft above the waterline, is considerably less advantageous since seawater can enter the interior of the bearing.

Where the shaft is mounted in a large-diameter collar bearing above the waterline, and the bearing diameter is approximately equal to or greater than the winding length of the electric motor, this results in the upper part of the shaft of the steering propeller being sufficiently spacious that the slipring arrangement and the rotating motors can be accommodated completely inside the shaft. This is especially true when the collar bearing also has a large internal diameter. Accordingly, it is possible to dispense with a separate machine room above the steering propeller with a concomitant saving in installed height. The collar bearing can be arranged directly under the car deck.

The present invention further provides for the drive motors to be in the form of flat hydraulic radial piston motors. This results in a particularly advantageous configuration of the rotating motors since they have small dimensions and a large torque.

The present invention advantageously provides for the possibility of connecting the shaft to the ship's hull via an intermediate covering part immediately under the lowermost cargo deck in the stern, for example the car deck in the case of Roro-ships. Such an intermediate covering part, which may also be in the form of an annular disk, advantageously results in the ability to install the electrical steering propeller such that it is both stable and physically small. The intermediate covering part can be arranged in the stern area both via mounting elements such as boxes, and directly by fitting it on to a double bottom. It is particularly advantageous in the case of Roro-ships if the shaft is mounted under a steering propeller sealing cover in the ship's stern, with the sealing cover being a component of the car deck. This results in particularly good utilization of the physical height available in the stern of the ship, which allows vehicles to be driven directly onto the inner car deck via the stern door. This allows the car deck to be used over the full length of the ship, thus resulting in significantly improved space utilization for the main car deck. Full utilization of the weather-deck area is likewise ensured, in which case the capstan drives etc. can advantageously be arranged under the weather deck in order to enlarge the usable area.

A preferred embodiment of the present invention is where the sealing cover is provided with access openings to individual components in the steering propeller, for example, to the slipring arrangement, to the drive motors, and to other essential functional elements. This eliminates the need to remove the sealing cover in the car deck while performing servicing work and minor repairs, since the components can be accessed via the openings.

Further, the present invention advantageously provides for the upper part of the steering propeller to be sealed in a fire-resistant manner from the lowermost deck in the stern area. This makes it possible to comply with the safety requirements for Roro or Ropax ships without needing to modify the advantageous configuration of the electrical steering propeller which only requires a minimal installed height.

The present invention furthermore provides the electrical steering propeller with sliprings for supplying power to and monitoring the motor which are at least partially in the form of concentric sliprings. This results in a small physical shape for power supply and signal transmission components. For electrical motors having more than three phases, for example 6-phase or 12-phase electric motors, as well as for split electric motors, the present invention provides for the power supply sliprings to be designed to have only three phases, and for a junction to a motor winding system having more than three phases to be made behind the slipring arrangement via power semiconductors, which form a local converter arranged in the shaft. It is thus also possible to supply power to polyphase or split electric motors with a physically small, relatively simply slipring body. This considerably simplifies the construction and considerably reduces the physical height of the slipring arrangement. Polyphase winding systems can thus be supplied with electrical power in a controlled, advantageous manner. The power semiconductors can be cooled via heat dissipation elements which are connected to the shaft casing by the seawater flowing around it.

The cables for power transmission are advantageously routed from the side to the slipring arrangement of the shaft. While this requires a separate connecting element on the slipring arrangement, the additional costs incurred as a result of this are more than compensated for by the gain in space. The connecting element can advantageously run between the vehicle lanes on the car deck of a Roro-ship. This therefore does not detract from the small installed height of the steering propeller.

As a result of the arrangement of the drives for the rotary movement and for the slipring body in the shaft upper part, they are close to the auxiliary appliances in the shaft, for example the bilge pumps and oil pumps, etc. If required, power semiconductors are also located in this area, since the lower shaft part is designed to be narrow to assist the flow and also act as a rudder. Further, since it is impossible to prevent heat accumulations from being formed, at least one fan can be arranged in the upper part of the shaft, which allows air to circulate in the shaft upper part, and if necessary, also allows air to be interchanged.

In a further preferred embodiment of the present invention, the transition from the upper part to the lower part of the shaft may be located at the same level as the outer skin of the ship, preferably entirely above the waterline. The flange between the upper part and lower part of the shaft can thus be removed from the flow around the hull, thus allowing the shaft to be replaced with the electric motor for repairs without any need for the ship to be docked. For reliably "dry" replacement, it is sufficient for the ship to be trimmed bow-down.

In yet a further preferred embodiment of the invention, the motor shaft of the steering propeller is inclined at an angle matched approximately to the stern profile of the ship. This results in a downstream flow in the stern area of the ship which makes use of the flow accelerated by the propellers to reduce the stern drag of the ship. The steering propeller according to the present invention can thus be arranged right at the stern without causing any disadvantageous effects on the flow. This advantageous configuration results in the maximum amount of space being gained. Thus, overall, not only does the use of the steering propeller according to the invention, with a small installed height, result in better utilization of the space available in the stern area of the ship's hull, but there is also no deterioration in the flow in the stern area in comparison to conventional steering propellers arranged more deeply under the ship.

BRIEF DESCRIPTION OF THE DRAWINGS

The invention is explained below in greater detail with reference to the drawings in which.

DETAILED DESCRIPTION OF THE DRAWINGS

Figure 1:
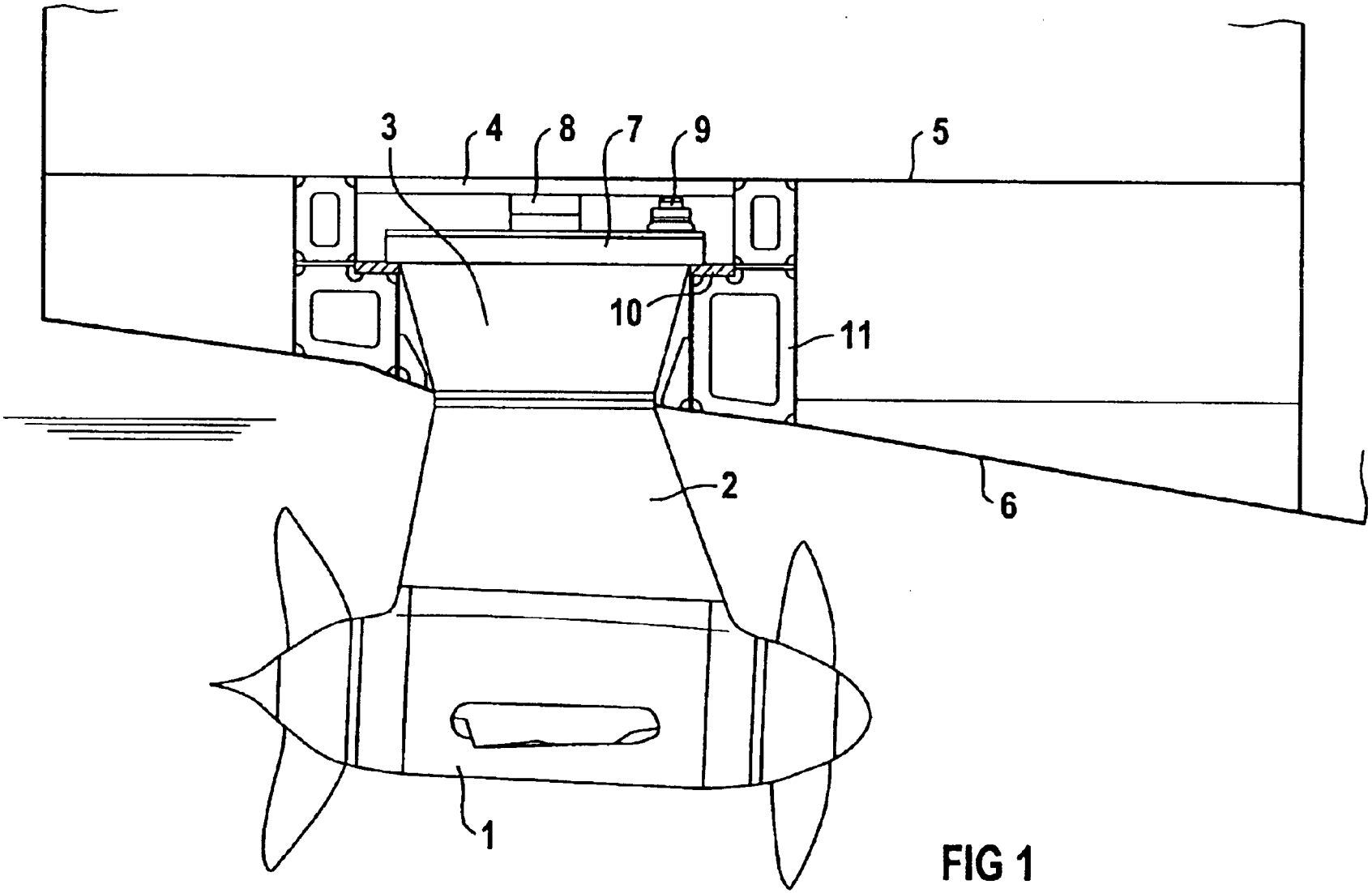
FIG. 1 is a side view of the steering propeller according to the invention illustrating its space-saving installation.

FIG. 1 shows a Roro or Ropax ship application having a small installed height between the ship's outer skin 6 and the car deck 5. All the components of the electrical steering propeller, with the exception of the shaft 2 and the motor part 1, are arranged in this small installed height. By way of example, this is achieved by an intermediate covering part 10, which can even be in the form of an annular disk inserted between the outer skin 6 of the ship and the car deck 5, and which has the steering propeller mounted thereon. The stationary parts of the collar bearing 7 are arranged above the intermediate covering part 10. A cover 4, which is preferably sealed in a fire-resistant manner, is installed in the car deck 5, through which the steering propeller unit located underneath is accessible. Various small covers (now shown) which provide easy access to the major functional parts of the steering propeller are inserted into the larger cover. The slipring arrangement 8 and the rotating motors 9 are located in the interior of the collar bearing 7 and in the shaft upper part 3. The collar bearing 7, together with the intermediate covering part 10 (which is physically small) is arranged in the stern of the ship, via a box structure 11.

The cover 4 is supported directly or indirectly on the intermediate covering part 10, so that the space under the cover 4 has a small physical height, and the overall installed height is thus optimally low. A bending-resistant power supply cable can advantageously be routed to the slipring arrangement 8 from the side, so that the cover 4 is smooth and can be mounted directly above the slipring arrangement 8.

The steering propeller itself is advantageously inclined such that is its drive axis runs at a rising angle to the rear. This improves the downstream flow even if the stern is short. In this case, the separating flange between the upper part of the steering propeller 3 and the shaft may be located approximately at the same level as the outer skin so that, if the steering propeller is arranged relatively far to the stern, and it is physically short, no flange parts need be arranged in the flow around the hull.

The cover 4 is advantageously provided with a fire-resistant seal so that in the event of a fire in this part of the drive system there is no risk to the car decks located above it. Conversely, the operation of the drive system is not adversely affected by a fire on the car deck, and the ship can still be propelled.

The low height between the intermediate covering part 10 and the cover 4 is also achieved by using flat radial piston hydraulic motors for the azimuth drive. The medium voltage for the main motor, the low voltage for the auxiliary systems, and the signals for control/regulation of the motor are transmitted via the electrical slipring arrangement 8, which is located in the upper part 3 of the shaft and, in particular, has a number of parts. The steering propeller itself can be rotated endlessly through 360°. The sliprings of the slipring arrangement 8 are arranged concentrically with respect to one another, with the signal transmission antennas (which are not shown in any greater detail) preferably being located on the outside.

Figure 2:
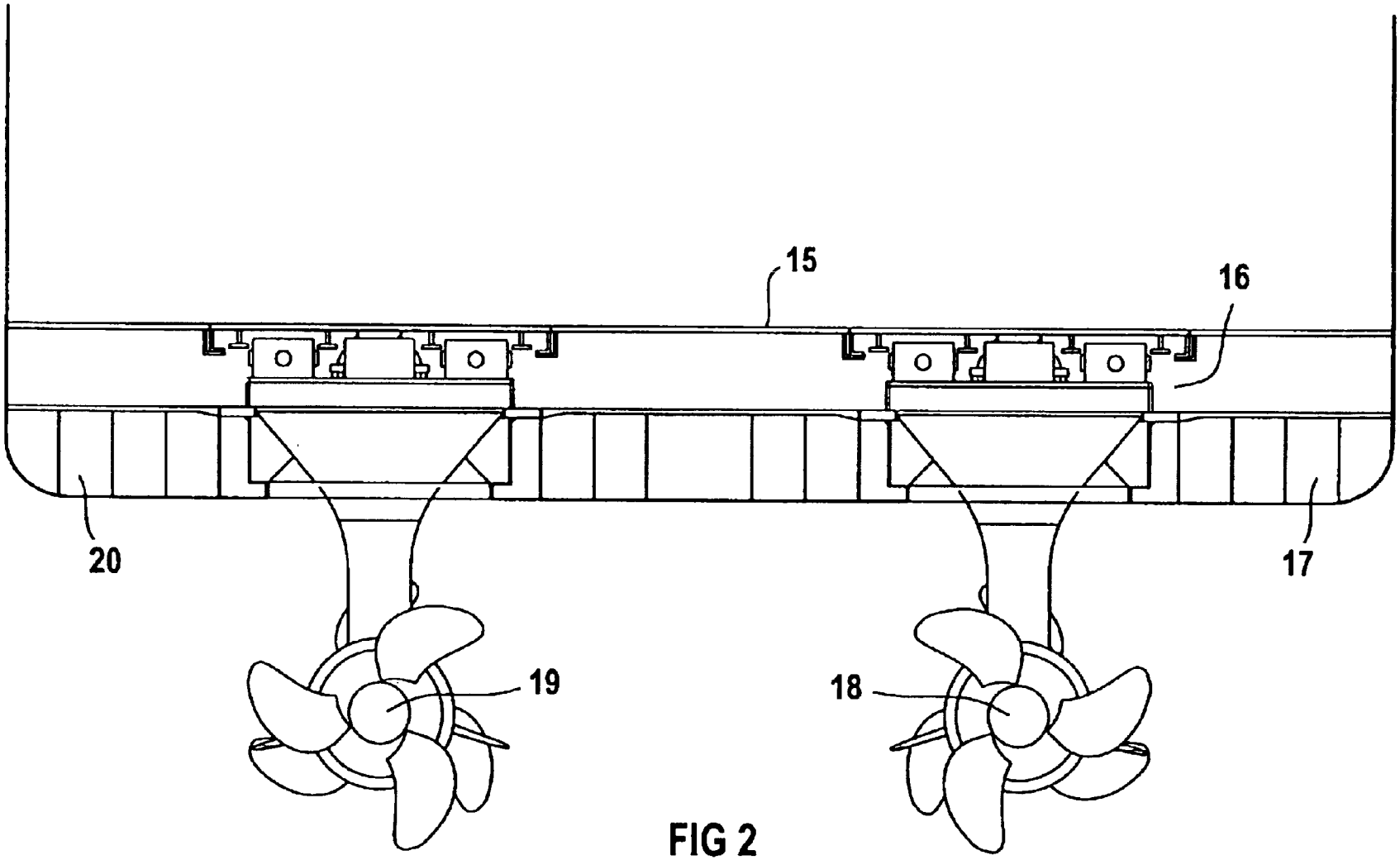
FIG. 2 is a rearview of a double steering propeller arrangement in the stern area of the ship.

FIG. 2 shows two steering propeller units 18 and 19. In this embodiment, the intermediate covering part is located directly on the ship's double bottom 17. The column bearing is mounted, for example, via struts, and the rotating motors are arranged in the same way as the slipring bodies in the intermediate space 16 underneath the car deck 15. This results in a small physical height for the installation of the steering propellers, which are arranged well astern.

Figure 3:
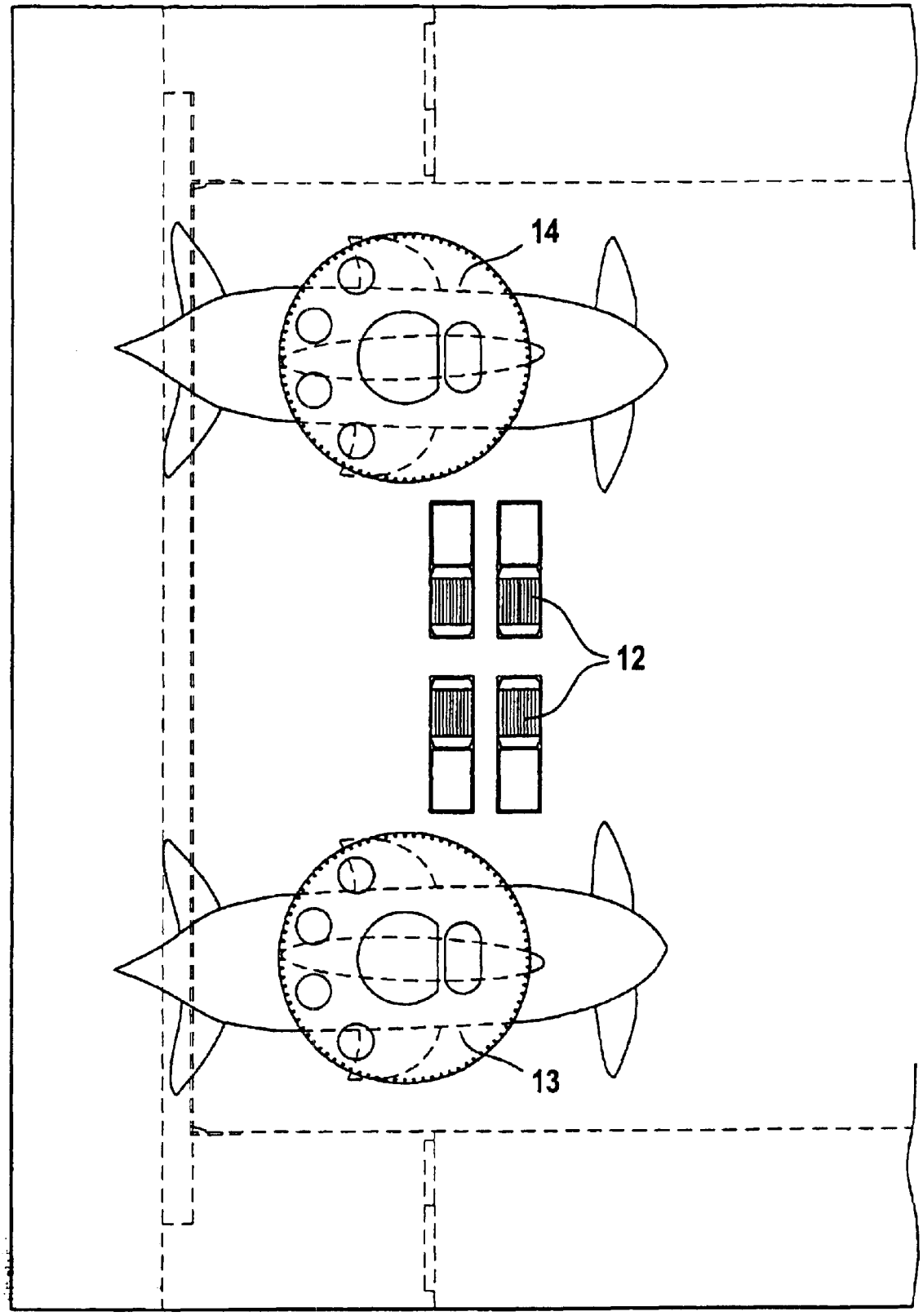
FIG. 3 is an overhead view of the double steering propeller arrangement illustrated in FIG. 2.

As shown in FIG. 3, the auxiliary appliances 12 of the azimuth drive, for example, the hydraulic pumps and their motors, are also located in the intermediate space underneath the car deck. The two steering propellers 13 and 14 are supplied with rotation power via short hydraulic lines. This makes it possible to dispense with a separate machine room above the steering propellers 13 and 14.

Figure 4:
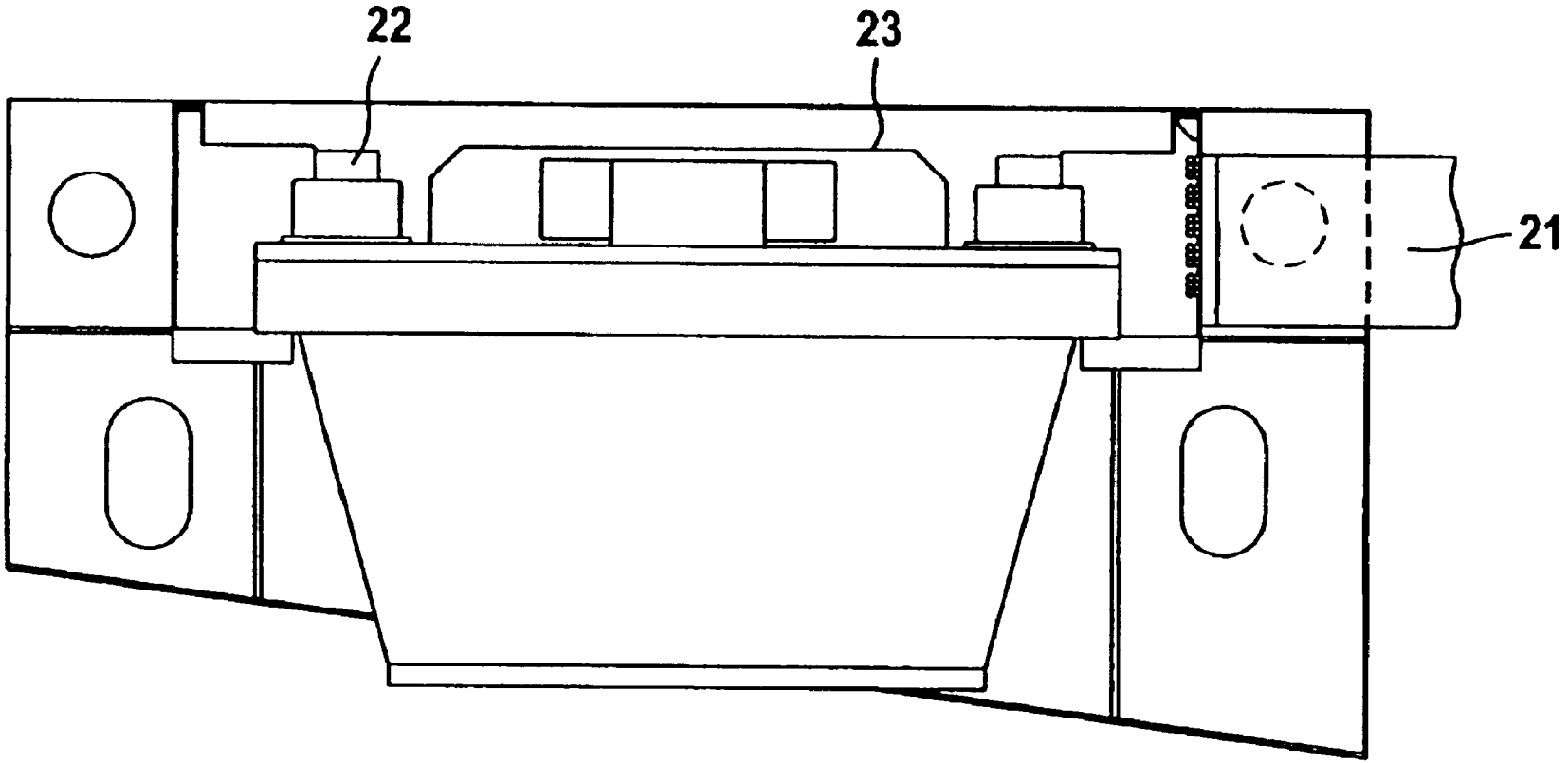
FIG. 4 is a side view of the upper part of the shaft with the cable supply at the side.

FIG. 4 shows a cable connection 21 which is routed at the side; an upper cover 23 on the slipring arrangement; and upper parts of the drives 22 for the rotary movement. FIG. 4 illustrates the small installed height which can be achieved in accordance with the present invention.

Figure 5:
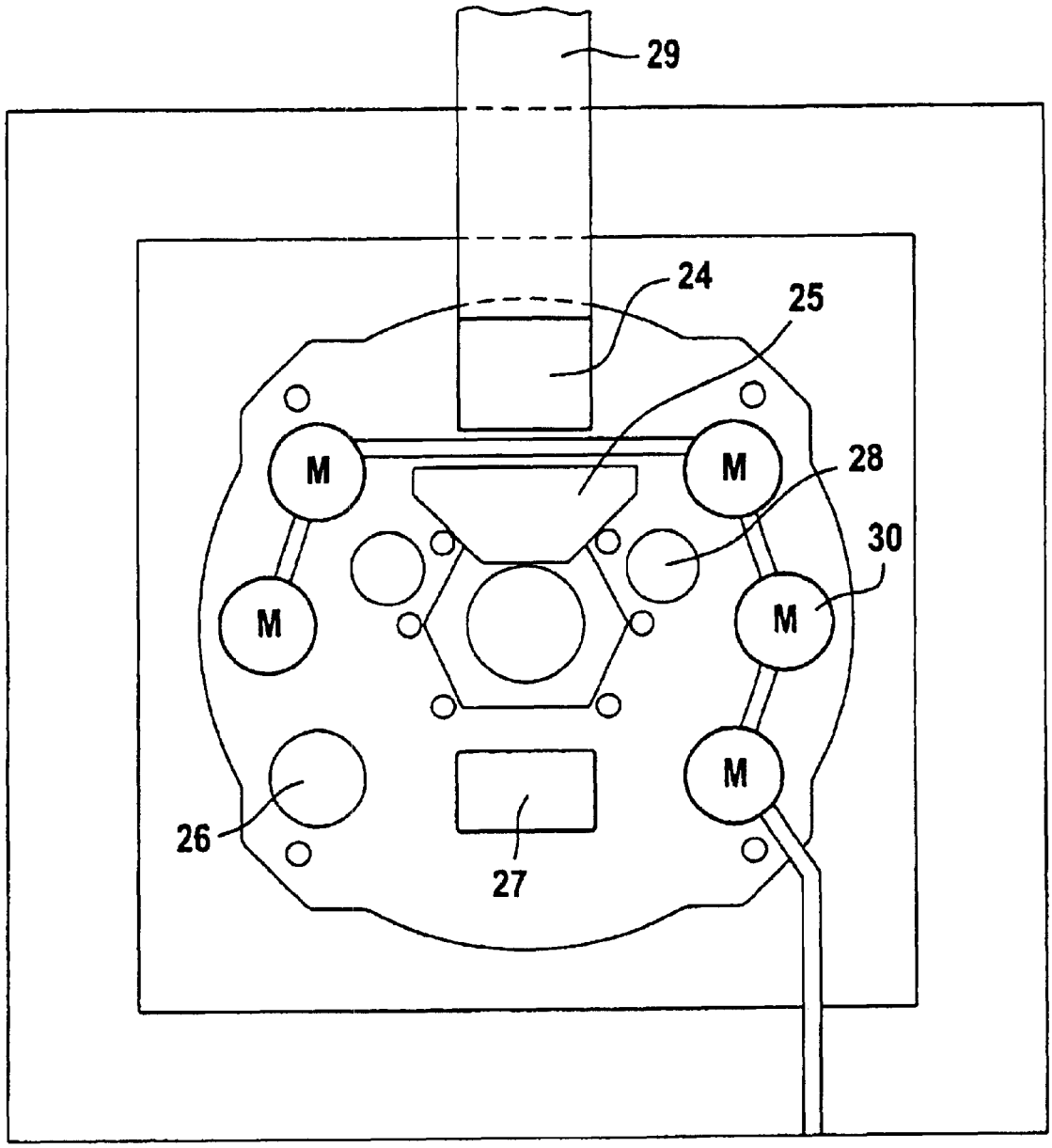
FIG. 5 is a top view of the upper part of the shaft as shown in FIG. 4.

FIG. 5 illustrates the connecting part 24 of the cable connection 29; an entry 27 into the shaft; a spare cross section 26; a fan 28; and a drive 30 for the rotary movement. Since these components have connecting lines, terminals, mounting elements, flanges etc., it is apparent that space optimization has been achieved in accordance with the present invention.

Figure 6:
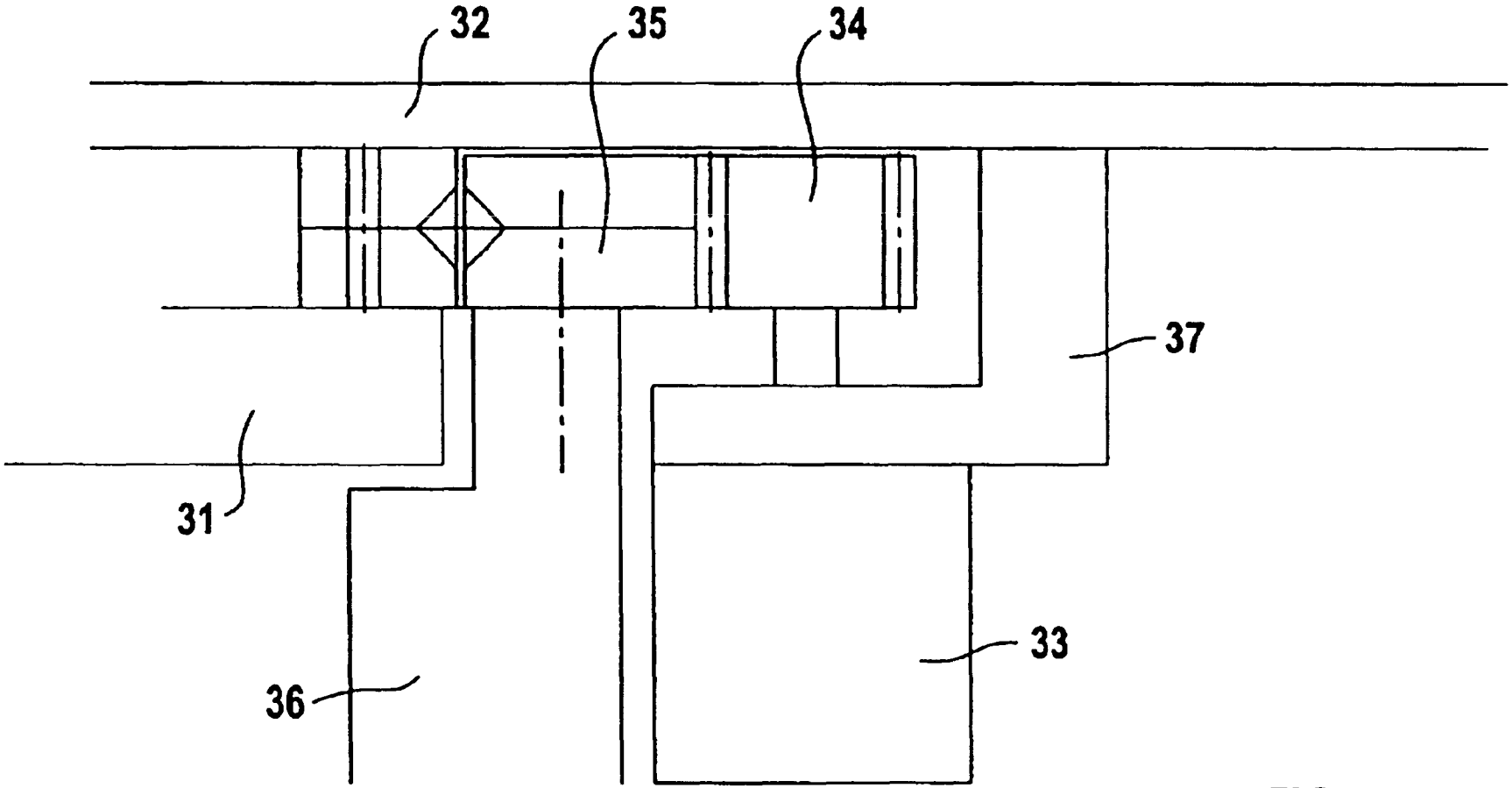
FIG. 6 is a view of a compressed section through a collar bearing arrangement having a particularly small installed height.

FIG. 6 shows a partial section of a physically small collar bearing according to the present invention. The structural part of the ship which forms the base of the collar bearing is identified by the reference number 31. This may be, for example, an intermediate covering part, a part of the double bottom or an annular part on the outer skin of the ship. Reference number 32 denotes, for example, the car deck in the case of a Roro ship, or the deckhead on the car deck. Reference number 33 denotes a motor for the rotary drive, which is mounted on a support 37. Reference number 34 denotes a drive pinion for the rotating ring 35 of the collar bearing. Finally, reference number 36 denotes the shaft of the steering propeller which is connected directly to the rotating part of the collar bearing. The connecting elements between the individual parts, such as flanges with bolts, welded seams, etc., are not shown, since FIG. 6 is an outline illustration of a particularly physically small bearing arrangement. In this case, the drive motors 33 for the rotary movement are even arranged completely inside the shaft.

As shown in FIGS. 2 and 3, the flow freely reaches the steering propellers, respectively 18, 19 and 13, 14 which is important especially for particularly low-vibration operation. Flow guide bodies can also be arranged upstream of the steering propellers, designed in the form of hooks, with the hook tip at the same level as the shafts of the steering propellers. This results in the ship moving straight ahead; improves the propulsion efficiency, and improves the downstream flow behavior of the ship's stern. However, in this case, the tendency of the drive system to vibrate must be optimized with respect to the advantages achieved, so that the flow guide bodies are more appropriate for Roro ferries, and are less suitable for Ropax ferries or for cruise ships. With appropriate optimization, all the ship types can advantageously be equipped with flow guide bodies arranged in front of the steering propellers and having a roughly droplet-shaped cross section. The flow guide bodies admittedly increase the wetted surface area, but their advantages for the ship behavior, downstream, drag, and propulsion efficiency may, however, more than compensate for this disadvantage. It is particularly advantageous to combine them with the physically small, possibly short, steering propellers according to the present invention, since this allows the additional wetted area to be kept small.

What is claimed is:

1. A ship having an electrical steering propeller comprising a polyphase electric motor mounted in a housing under the ship's stern via a shaft having upper and lower parts and which is rotated by a drive motor, further comprising a slipring arrangement for supplying electrical drive power, a flat collar bearing for mounting the steering propeller and located proximally to the ship's outer skin, wherein the slipring is located in the upper part of the shaft proximal to the collar bearing and the drive motors are located at least partially in the interior of the collar bearing, thereby achieving a compact installed arrangement of the aforesaid components of the steering propeller.

2. The ship according to claim 1, wherein the electrical steering propeller is mounted below the waterline in the stern of the ship in a gondola-like housing.

3. The ship according to claim 1, wherein the collar bearing is connected to the ship's stern via an intermediate covering.

4. The ship according to claim 3, wherein the intermediate covering has an annular configuration and is connected to the ship's stern via a box structure.

5. The ship according to claim 3, wherein the intermediate covering has an annular configuration and is connected to a double bottom of the ship.

6. The ship according to claim 3, wherein the intermediate covering is located immediately under a lowermost cargo deck in the ship's stern area.

7. The ship according to claim 1, wherein the shaft is mounted under a sealing cover in the ship's stern.

8. The ship as according to claim 7, wherein the sealing cover is a component of a lower most cargo deck in the ship's stern.

9. The ship according to claim 7, wherein the sealing cover has openings to access components of the steering propeller including the slipring, drive motors and other essential elements.

10. The ship according to claim 1, wherein the drive motors are flat radial piston hydraulic motors.

11. The ship according to claim 1, wherein the collar bearing has a toothed rim for the rotary movement on a rotatable ring of the collar bearing, and a stationary ring is connected to a structural part of the ship.

12. The ship according to claim 11, wherein the motors are arranged under the collar bearing in the shaft upper part and held via supports and engaged via pinions in a rotatable ring of the collar bearing.

13. The ship according to claim 10, wherein hydraulic pumps for driving the motors are located in the shaft.

14. The ship according to claim 1, wherein electrical power for the slipring is supplied via a cable which is routed to the slipring arrangement so as to enable the sealing cover to be smooth.

15. The ship according to claim 14, wherein the slipring has a connecting element for connecting the cable.

16. The ship according to claim 1, wherein the electrical steering propeller further comprises at least one fan located in the upper part of the shaft.

17. The ship according to claim 1, wherein the diameter of the shaft upper part is at least equal to a winding length of the electric motor.

18. The ship according to claim 1, wherein the upper part of the shaft is sealed in a fire-resistant manner from the ship's lower most deck area.

19. The ship according to claim 1, wherein the sliprings supplying power to and monitoring the motor are at least partially in the form of concentric sliprings.

20. A ship according to claim 1, wherein the sliprings are two-phase or three-phase sliprings and further comprising a junction for a motor winding system having more than two or three phases located behind the slipring.

21. The ship according to claim 1, wherein the upper part of the shaft interfaces the lower part of the shaft at approximately the same level as the outer skin of the ship.

22. The ship according to claim 21, wherein the interface between the upper part and the lower part of the shaft is located above the ship's outer skin.

23. The ship according to claim 1, wherein the shaft of the steering propeller is arranged so that the propeller's flow follows approximately the stern profile of the ship.

24. The ship according to claim 1, wherein the flat collar bearing is located above the ship's waterline.

25. The ship according to claim 13, wherein the hydraulic pumps are in the form of power packs.

26. The ship according to claim 20, wherein the junction is made via power semi conductors in the form of a local converted located in the shaft.

* * * * *